US008662057B2

(12) United States Patent
Kuroki et al.

(10) Patent No.: US 8,662,057 B2
(45) Date of Patent: Mar. 4, 2014

(54) WORKING GAS CIRCULATION ENGINE

(75) Inventors: Rentaro Kuroki, Susono (JP); Daisaku Sawada, Gotenba (JP); Akira Kato, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/058,568

(22) PCT Filed: Oct. 19, 2009

(86) PCT No.: PCT/JP2009/005452

§ 371 (c)(1),
(2), (4) Date: Feb. 11, 2011

(87) PCT Pub. No.: WO2011/048624

PCT Pub. Date: Apr. 28, 2011

(65) Prior Publication Data

US 2012/0227713 A1 Sep. 13, 2012

(51) Int. Cl.
*F02M 25/07* (2006.01)
*F02B 13/00* (2006.01)

(52) U.S. Cl.
USPC ..... 123/568.11; 123/575

(58) Field of Classification Search
USPC ..... 701/101–103, 108; 123/1 A, 3, 525, 123/527, 575–578, 568.11–568.15, 568.21, 123/568.22, 568.31, DIG. 12, DIG. 13; 60/274, 278, 286, 299, 320, 321
See application file for complete search history.

(56) References Cited

U.S. PATENT DOCUMENTS

| | | | | |
|---|---|---|---|---|
| 5,016,599 | A | 5/1991 | Jubb | |
| 7,661,416 | B2 * | 2/2010 | Sasajima et al. | 123/568.12 |
| 2011/0056466 | A1 * | 3/2011 | Kuroki et al. | 123/568.11 |
| 2011/0067664 | A1 * | 3/2011 | Kuroki et al. | 123/1 A |
| 2011/0209691 | A1 * | 9/2011 | Kuroki et al. | 123/568.21 |

FOREIGN PATENT DOCUMENTS

| | | |
|---|---|---|
| JP | 49-82839 | 8/1974 |
| JP | 3-501993 | 5/1991 |
| JP | 2007-64092 | 3/2007 |

* cited by examiner

*Primary Examiner* — John T. Kwon
*Assistant Examiner* — Johnny Hoang
(74) *Attorney, Agent, or Firm* — Finnegan, Henderson, Farabow, Garrett & Dunner, LLP

(57) ABSTRACT

The working gas circulation engine includes a circulation route capable of circulating gas containing the working gas from an exhaust side to an intake side of a combustion chamber and resupplying to the combustion chamber and provided with a removing device to remove a product generated with a reaction from the circulating gas, a supplying device capable of supplying plural kinds of reactant gas to the combustion chamber or the circulation route, a pressure detecting device capable of detecting pressure in the circulation route, and a control unit that controls supply amount of at least one kind of the reactant gas to be supplied from the supplying device based on the pressure in the circulation route detected by the pressure detecting device, and performs pressure control to adjust the pressure in the circulation route.

7 Claims, 5 Drawing Sheets

WORKING GAS CIRCULATION ENGINE

CROSS-REFERENCE TO RELATED APPLICATION

This application is a national phase application of International Application No. PCT/JP2009/005452, filed Oct. 19, 2009, the contents of which are incorporated herein by reference.

FIELD

The present invention relates to a working gas circulation engine, and in particular, relates to a working gas circulation engine capable of circulating working gas from an exhaust side to an intake side of a combustion chamber and resupplying to the combustion chamber.

BACKGROUND

A working gas circulation engine, so-called a closed cycle engine, capable of circulating working gas from an exhaust side to an intake side of a combustion chamber and resupplying to the combustion chamber has been known as an engine in the conventional art. As such a typical working gas circulation engine, Patent Literature 1, for example, discloses an internal combustion engine utilizing inert gas as the working gas while combusting hydrogen as fuel in the combustion chamber. In the internal combustion engine, water vapor as a product contained in the gas exhausted from the combustion chamber is removed by a water removing device and the inert gas having water vapor removed therefrom is recirculated to the combustion chamber via a circulation route while molecules of the inert gas dissolved in the removed water is returned into a state of gas by a degasifier and resupplied to the combustion chamber as well. Accordingly, consumption amount of the working gas is reduced.

CITATION LIST

Patent Literature

Patent Literature 1: Japanese Patent Application Laid-open No. 2007-064092

SUMMARY

Technical Problem

By the way, in the internal combustion engine described in above Patent Literature 1, in the case that temperature of gas circulating through the circulation route is varied corresponding to variation of a warming-up condition or a driving-load condition of an internal combustion engine main body or variation of external environment temperature, for example, there has been a fear that pressure in the circulation route which basically forms a closed system is excessively varied due to expansion or contraction of the gas.

The present invention provides a working gas circulation engine capable of suppressing excessive pressure variation in a circulation route.

Solution to Problem

In order to achieve the above mentioned object, a working gas circulation engine according to the present invention includes a combustion chamber to which plural kinds of reactant gas and working gas having a higher specific heat ratio than air are supplied and in which the working gas is expandable corresponding to reaction of the plural kinds of reactant gas; a circulation route capable of circulating gas containing the working gas from an exhaust side to an intake side of the combustion chamber and resupplying to the combustion chamber and provided with a removing device to remove a product generated with the reaction from the circulating gas; a supplying device capable of supplying the plural kinds of reactant gas to the combustion chamber or the circulation route; a pressure detecting device capable of detecting pressure in the circulation route; and a control unit that controls supply amount of at least one kind of the reactant gas to be supplied from the supplying device based on the pressure in the circulation route detected by the pressure detecting device, and performs pressure control to adjust the pressure in the circulation route.

Further, in the working gas circulation engine, the control unit may perform the pressure control so that an absolute value of differential pressure between the pressure in the circulation route detected by the pressure detecting device and atmospheric pressure is equal to or smaller than a previously set predetermined value.

Further, in the working gas circulation engine, the control unit may adjust supply amount of at least one kind of the reactant gas supplied from the supplying device to be larger than supply amount corresponding to a theoretical ratio of the reaction with another of the reactant gas in a case of performing the pressure control to increase the pressure in the circulation route, and adjust supply amount of at least one kind of the reactant gas supplied from the supplying device to be smaller than the theoretical ratio of the reaction with the other of the reactant gas in a case of performing the pressure control to decrease the pressure in the circulation route.

Further, in the working gas circulation engine, the supplying device may be configured to include an oxygen supplying device to supply oxygen as one of the plural kinds of reactant gas and a hydrogen supplying device to supply hydrogen to be combusted with the oxygen as one of the plural kinds of reactant gas, and the control unit may perform the pressure control by controlling supply amount of the oxygen to be supplied from the oxygen supplying device.

Further, in the working gas circulation engine, the supplying device may supply the reactant gas of which supply amount to the circulation route is controlled to adjust the pressure in the circulation route.

Further, in the working gas circulation engine, the control unit may perform the pressure control in both operation states of an operation state with occurrence of the reaction of the plural kinds of reactant gas in the combustion chamber and an operation state without occurrence of the reaction of the plural kinds of reactant gas in the combustion chamber.

Further, in the working gas circulation engine, the control unit may perform the pressure control so that the pressure in the circulation route detected by the pressure detecting device is to be larger than atmospheric pressure within a range of a previously set predetermined value.

Advantageous Effects of Invention

With a working gas circulation engine according to the present invention, excessive pressure variation in the circulation route can be suppressed.

DESCRIPTION OF EMBODIMENTS

In the following, embodiments of an working gas circulation engine according to the present invention will be described in detail with reference to the drawings. Here, the embodiments are not to limit the present invention. Further, structural elements of the following embodiments include those being possible and easy to be replaced by a person skilled in the art and those being substantially the same.

Embodiments

Figure 1:
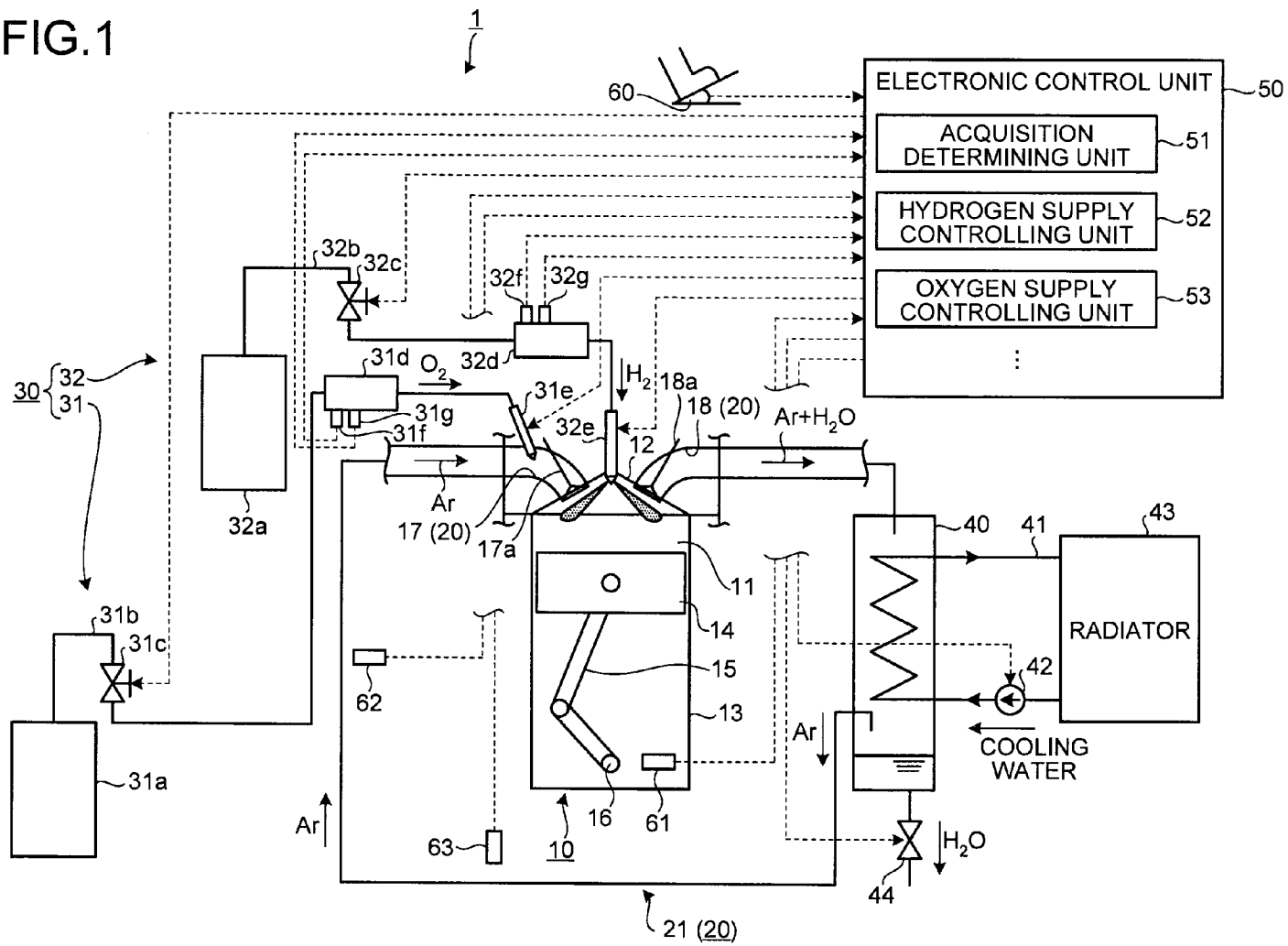
FIG. 1 is a schematically simplified structural view of a working gas circulation engine according to an embodiment.
Figure 2:
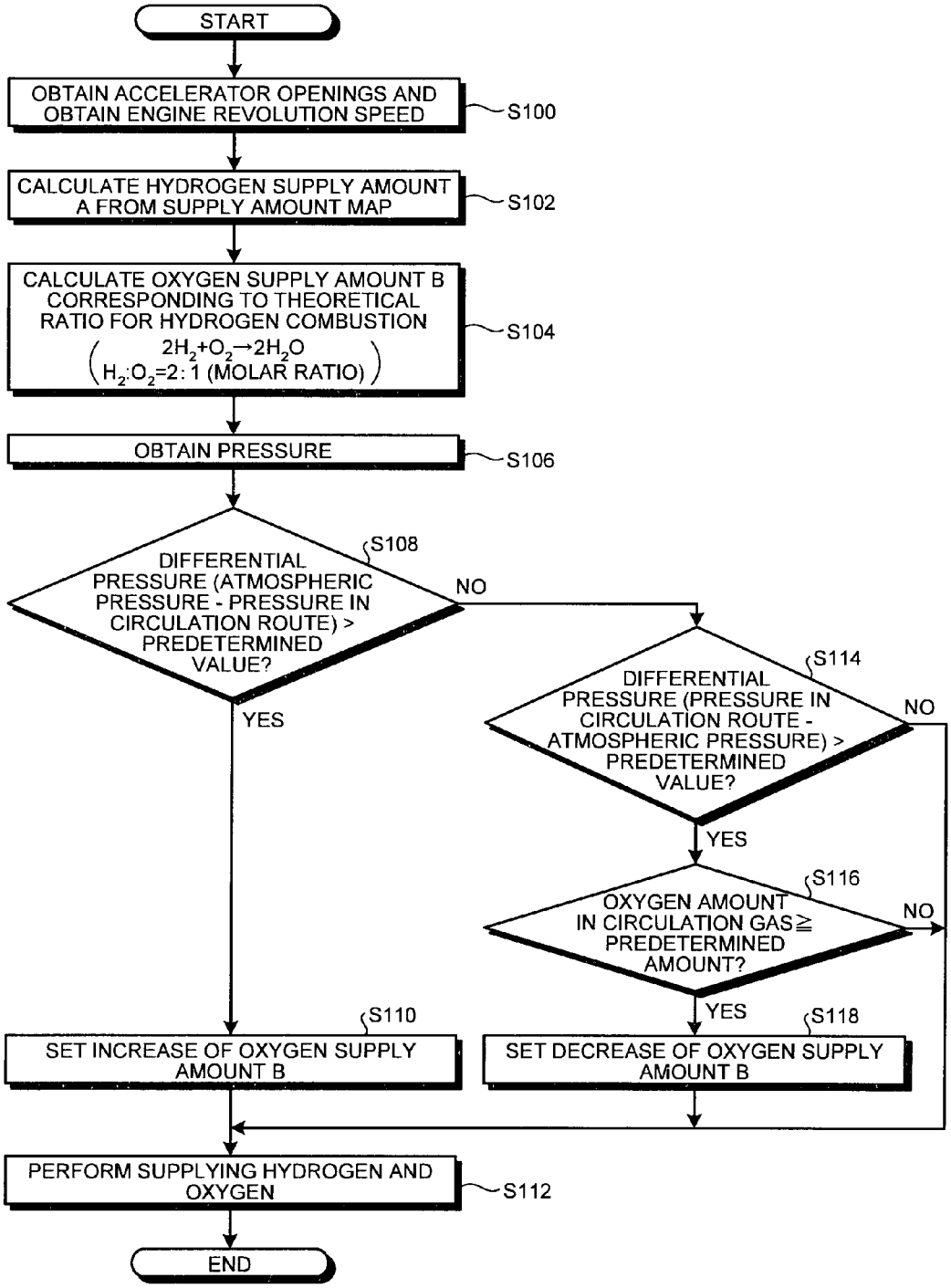
FIG. 2 is a flowchart explaining an example of pressure control in operation of the working gas circulation engine according to the embodiment.
Figure 3:
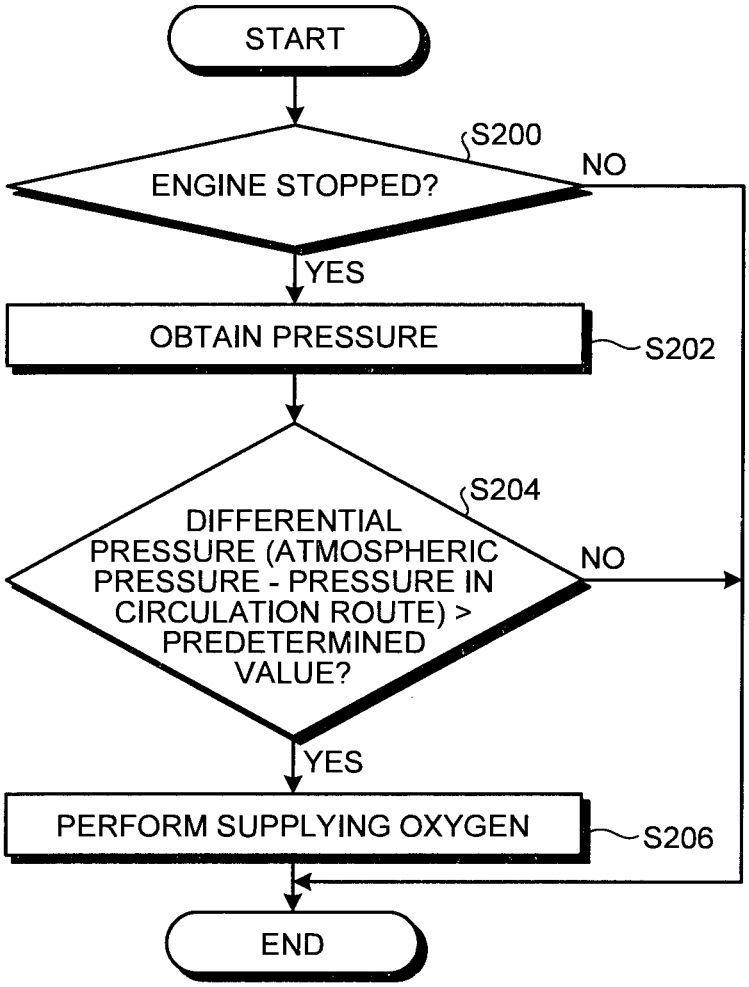
FIG. 3 is a flowchart explaining an example of pressure control in non-operation of the working gas circulation engine according to the embodiment.
Figure 4:
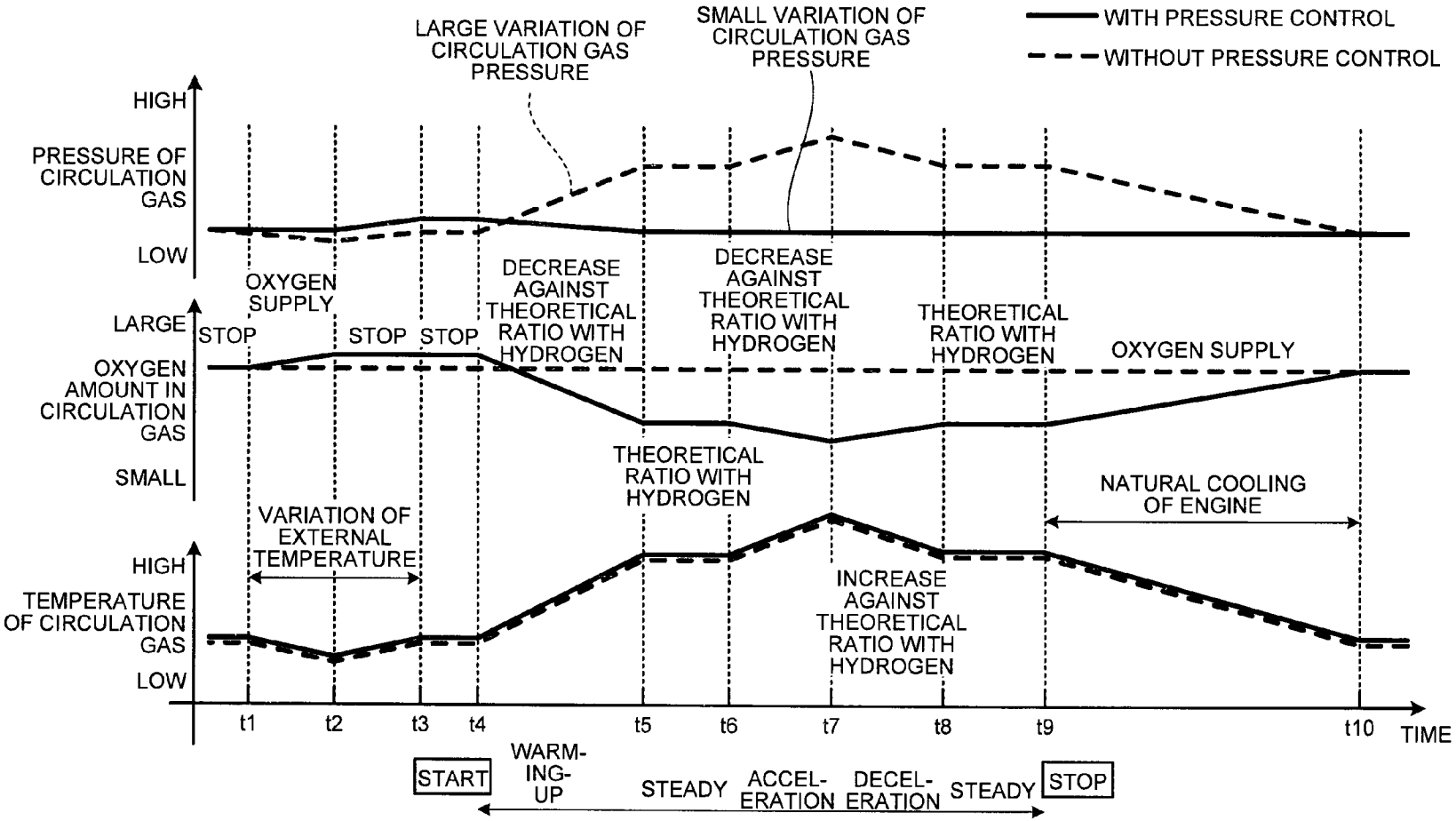
FIG. 4 is a time chart explaining an example of operation of the working gas circulation engine according to the embodiment.

FIG. 1 is a schematically simplified structural view of the working gas circulation engine according to the embodiment. FIG. 2 is a flowchart explaining an example of pressure control in operation of the working gas circulation engine according to the embodiment. FIG. 3 is a flowchart explaining an example of pressure control in non-operation of the working gas circulation engine according to the embodiment. FIG. 4 is a time chart explaining an example of operation of the working gas circulation engine according to the embodiment.

In a working gas circulation engine 1 of the present embodiment illustrated in FIG. 1, plural kinds of reactant gas and working gas having a higher specific heat ratio than air are supplied to a combustion chamber 11 of an engine main body 10 and the working gas expands corresponding to reaction of the plural kinds of reactant gas at the combustion chamber 11, so that power is generated. The working gas circulation engine 1 is a so-called closed-cycle engine configured to be capable of circulating the working gas from an exhaust side to an intake side of the combustion chamber 11 via a circulation route 20 connecting the intake side and the exhaust side of the combustion chamber 11 and resupplying to the combustion chamber 11 basically without discharging to the atmosphere. Both the combustion chamber 11 and the circulation route 20 are filled with the working gas and the working gas is circulated between the combustion chamber 11 and the circulation route 20.

Here, the plural kinds of reactant gas utilized for the working gas circulation engine 1 are two kinds which are oxygen ($O_2$) serving as oxidizer and hydrogen ($H_2$) serving as a fuel. Further, the working gas utilized for the working gas circulation engine 1 has a higher specific heat ratio than air and is argon (Ar) which is a monatomic gas in this case. Argon is expanded in the combustion chamber 11 with reaction heat generated corresponding to the reaction of oxygen and hydrogen, that is, combustion heat generated corresponding to combustion (i.e., exothermal reaction) of hydrogen. That is, the working gas circulation engine 1 improves the heat efficiency by combusting hydrogen in the combustion chamber 11 and generating power with heat expansion of argon corresponding to the combustion of hydrogen.

Specifically, as illustrated in FIG. 1, the working gas circulation engine 1 includes the engine main body 10 provided with the combustion chamber 11 in which oxygen and hydrogen react, the circulation route 20 to connect the exhaust side and the intake side of the combustion chamber 11, a supplying device 30 to supply oxygen and hydrogen, a condenser 40 as a removing device, and an electronic control unit 50 as a control device.

The engine main body 10 is configured to include the combustion chamber 11 to which oxygen and hydrogen as the plural kinds of reactant gas and argon as the working gas are supplied as argon being expandable corresponding to the reaction of oxygen and hydrogen and which is capable of discharging water vapor and working gas as the gas after combustion of hydrogen. The combustion chamber 11 is formed as a space defined as being surrounded by a lower face of a cylinder head 12, a cylinder bore wall face of a cylinder block 13, and a top face of a piston 14. The piston 14 is connected to a crank shaft 16 via a connecting rod 15.

The engine main body 10 has an intake port 17 and an exhaust port 18 formed at the cylinder head 12. Both the intake port 17 and the exhaust port 18 constitute a part of the circulation route 20 and are connected at one end thereof respectively to the combustion chamber 11 as being opened to the combustion chamber 11. In the engine main body 10, an intake valve 17*a* is arranged at the intake port 17 and an exhaust valve 18*a* is arranged at the exhaust port 18. The intake valve 17*a* and the exhaust valve 18*a* are driven to open and close as being interlocked with rotation of the crank shaft 16, for example.

The circulation route 20 is capable of circulating circulation gas containing argon from the exhaust side to the intake side of the combustion chamber 11 and resupplying to the combustion chamber 11. The circulation route 20 and the combustion chamber 11 form a basically closed space as a whole with various seal members and the like. In the working gas circulation engine 1, the closed space constituted with the circulation route 20 and the combustion chamber 11 is filled with argon as the working gas.

In addition to the above intake port 17 and exhaust port 18, the circulation route 20 is configured to further include a circulation passage 21. The circulation passage 21 is constituted with a tubular inner-pipe passage in which fluid can pass through, for example, and connected to the intake port 17 and the exhaust port 18 at the outside of the combustion chamber 11. Here, the circulation passage 21 is divided into plurals and a later-mentioned condenser 40 is arranged between the divided circulation passage 21. An intake side (for example, an intake pipe) of the circulation passage 21 is connected to the intake port 17 at an opening end part opposed to the combustion chamber 11 and an exhaust side (for example, an exhaust pipe) thereof is connected to the exhaust port 18 at an opening end part opposed to the combustion chamber 11.

Here, the circulation gas is the gas circulated from the exhaust side to the intake side of the combustion chamber 11 via the circulation route 20 and contains exhaust gas and the like discharged from the combustion chamber 11 after combustion of hydrogen at the combustion chamber 11 in addition to argon as the working gas. Here, for example, the exhaust gas contains excessive gas constituted with excessive oxygen, hydrogen and the like remaining after combustion of hydrogen at the combustion chamber 11, water vapor ($H_2O$) as a product generated corresponding to combustion of hydrogen, and the like. That is, the circulation gas in this case contains argon as the working gas, excessive gas constituted with excessive oxygen, hydrogen and the like after combustion, water vapor, and the like.

The circulation route 20 supplies circulation gas containing argon to the combustion chamber 11 via the circulation passage 21 and the intake port 17. The circulation gas circulating through the circulation route 20 is sucked to the combustion chamber 11 during opening of the intake valve 17*a* along with oxygen from a later-mentioned oxygen supplying device 31. Meanwhile, in the circulation route 20, exhaust gas is discharged to the exhaust port 18 and the circulation passage 21 from the combustion chamber 11 along with argon. The exhaust gas after combustion of hydrogen at the combustion chamber 11 is discharged to the exhaust port 18 during opening of the exhaust valve 18*a* along with argon, and then, the exhaust gas and argon are circulated through the circulation route 20 as circulation gas and sucked into the combustion chamber 11 again. A condenser 40 (described later) is arranged at some point of the circulation route 20 and most water vapor in the circulation gas is removed by the condenser 40 and discharged to the outside of the circulation system.

The supplying device 30 is to supply plural kinds of reactant gas, that is, oxygen and hydrogen, to the combustion chamber 11 or the circulation route 20. The supplying device 30 is configured to include an oxygen supplying device 31 to supply oxygen to the circulation route 20 as one of the plural kinds of reactant gas and a hydrogen supplying device 32 to supply hydrogen to the combustion chamber 11 as one of the plural kinds of reactant gas to be combusted with oxygen.

The oxygen supplying device 31 supplies oxygen to the circulation route 20, that is, the intake port 17 in this case. The oxygen supplying device 31 supplies high-pressure oxygen stored at an oxygen tank 31*a* to an injection valve 31*e* via a regulator 31*c*, a surge tank 31*d* and the like on a supplying pipe 31*b* and supplies as injecting toward the inside of the intake port 17 from the injection valve 31*e*. The injection valve 31*e* injects oxygen into the circulation gas flowing in the intake port 17 toward the combustion chamber 11. Further, in the oxygen supplying device 31, an oxygen temperature sensor 31*f* and an oxygen pressure sensor 31*g* are attached to the surge tank 31*d*.

The hydrogen supplying device 32 supplies hydrogen directly to the combustion chamber 11. The hydrogen supplying device 32 supplies high-pressure hydrogen stored at a hydrogen tank 32*a* to an injection valve 32*e* via a regulator 32*c*, a surge tank 32*d* and the like on a supplying pipe 32*b* and supplies as directly injecting toward the inside of the combustion chamber 11 from the injection valve 32*e*. The injection valve 32*e* injects hydrogen into the gas in the combustion chamber 11. Further, in the hydrogen supplying device 32, a hydrogen temperature sensor 32*f*, a hydrogen pressure sensor 32*g* are attached to the surge tank 32*d*.

The condenser 40 is arranged at the circulation route 20 and removes a product generated with the reaction of oxygen and hydrogen, that is, water vapor from the circulation gas circulating through the circulation route 20. The condenser 40 cools the circulation gas with heat exchange between cooling water and the circulation gas flowing through the circulation route 20 performed by moving the cooling water cooled at a radiator 43 to the inside of the condenser 40 flowing through a cooling water circulation passage 41 as a cooling water pump 42 arranged at the cooling water circulation passage 41 being operated. Accordingly, the condenser 40 liquefies and condenses water vapor contained in the circulation gas into condensed water and separates the water vapor from the circulation gas. Then, the circulation gas having the water vapor separated by the condenser 40 directly circulates through the circulation route 20. Condensed water accumulated at a bottom portion in the condenser 40 is discharged to the outside of the circulation route 20 system via a water drain control valve 44 and the like.

The electronic control unit 50 is an electronic circuit having a well-known micro-computer as a main part including a CPU, a ROM, a RAM and an interface and controls each part of the working gas circulation engine 1. The electronic control unit 50 receives electric signals corresponding to accelerator opening, crank angle being rotational angle of the crank shaft 16, oxygen temperature, oxygen supply pressure, hydrogen temperature and hydrogen supply pressure detected by an accelerator opening sensor 60, a crank angle sensor 61, the oxygen temperature sensor 31*f*, the oxygen pressure sensor 31*g*, the hydrogen temperature sensor 32*f*, the hydrogen pressure sensor 32*g* and the like. For example, the electronic control unit 50 can calculate revolution speed while discriminating respective strokes of intake, compression, expansion (combustion) and exhaust at each cylinder of the working gas circulation engine 1 based on the crank angle. Then, the electronic control unit 50 outputs drive signals to the injection valves 31*e*, 32*e*, the cooling water pump 42, the water drain control valve 44 and the like based on detection results of the various sensors and controls driving thereof.

As described above, the working gas circulation engine 1 is exemplified as supplying hydrogen and oxygen into the combustion chamber 11 and as diffusing and combusting hydrogen. That is, in the working gas circulation engine 1, a part of the hydrogen is self-ignited and hydrogen and compressed gas (i.e., oxygen) are combusted as being diffusively mixed by injecting high-pressure hydrogen into high-temperature compressed gas (i.e., oxygen and argon) formed in the combustion chamber 11. Due to the combustion of hydrogen in the combustion chamber 11, heat expansion occurs at argon having a large specific heat ratio while water vapor is generated as hydrogen and oxygen being bonded in the combustion chamber 11. As a result, in the working gas circulation engine 1, the piston 14 is depressed due to diffusive combustion of hydrogen and heat expansion of argon and the piston 14 repeats reciprocation motion in the cylinder bore, so that the cycle of an intake stroke, a compression stroke, a combustion stroke and an exhaust stroke being as one cycle is repeated. During that time, the reciprocation motion of the piston 14 is converted into rotation motion of a crank shaft 16 with an action of the connecting rod 15 and the crank shaft 16. Accordingly, the working gas circulation engine 1 generates power.

Then, in the working gas circulation engine 1, after a sequence of combustion of hydrogen and heat expansion of argon is completed, exhaust gas containing excessive gas and water vapor along with argon are discharged to the exhaust port 18 from the inside of the combustion chamber 11 corresponding to opening of the exhaust valve 18*a*. In the working gas circulation engine 1, when argon and exhaust gas containing excessive gas and water vapor are circulated through the circulation route 20 toward the combustion chamber 11 as the circulation gas, the water vapor in the circulation gas is separated as being liquefied and condensed by the condenser 40. Accordingly, since water vapor having a small specific heat ratio is not supplied to the combustion chamber 11 while argon having a large specific heat ratio is resupplied to the combustion chamber 11, the working gas circulation engine 1 can perform operation of high heat efficiency due to argon as being the working gas.

During that time, the electronic control unit 50 determines supply amount of oxygen and hydrogen for enabling to obtain drive force (i.e., engine output) required by a driver at a current engine revolution speed basically in accordance with accelerator opening corresponding to operational amount of an accelerator pedal by the driver and a drive state such as engine revolution speed, and then, controls the supply amount (i.e., injecting amount) and supply timing (i.e., injection timing) of oxygen and hydrogen due to the oxygen supplying device 31 and the hydrogen supplying device 32.

By the way, in the working gas circulation engine 1, there is a fear that pressure in the circulation route 20 basically forming a closed system is excessively varied due to expansion or contraction of the gas in the case that temperature of the circulation gas circulating through the circulation route 20 is varied corresponding to variation of a warming-up condition or a driving-load condition of the engine main body 10 or variation of external environment temperature, for example. When the engine main body 10 is to be in a warmed-up state from a cold state due to repeated driving or when temperature of the exhaust gas discharged from the combustion chamber 11 is relatively increased as a heat value generated by combustion of oxygen and hydrogen being relatively increased due to being in a high-load drive state of the engine main body 10, temperature of the circulation gas circulating through the circulation route 20 is relatively increased in the working gas circulation engine 1. On the contrary, when the engine main body 10 is to be in a cold state as the engine main body 10 is stopped or when temperature of the exhaust gas discharged from the combustion chamber 11 is relatively decreased as a heat value generated by combustion of oxygen and hydrogen being relatively decreased due to being in a low-load drive state of the engine main body 10, temperature of the circulation gas circulating through the circulation route 20 is relatively decreased in the working gas circulation engine 1. Here, the working gas circulation engine 1 has the configuration that the circulation gas containing high temperature working gas and exhaust gas discharged from the combustion chamber 11 is basically not to be discharged to the outside of the system from the circulation route 20 at the time of circulating working gas discharged from the combustion chamber 11 to the intake side from the exhaust side of the combustion chamber 11 and to resupply to the combustion chamber 11. Therefore, when temperature of the circulation gas is varied as described above and expansion or contraction of gas occurs corresponding thereto, pressure in the circulation route 20 is to be varied.

Then, in the working gas circulation engine 1, when pressure in the circulation route 20 is excessively increased to be excessively larger than pressure of the outside of the circulation route 20, that is, atmospheric pressure, for example, there is a fear that unintentional leakage of argon and the like is caused from the inside of the circulation route 20 to the outside of the circulation route 20 via seams of various passage and piping of the intake port 17, the exhaust port 18 and the circulation passage 21 constituting the circulation route 20, the cylinder head 12 and the cylinder block 13 constituting the engine main body 10, and the like. On the contrary, in the working gas circulation engine 1, when pressure in the circulation route 20 is excessively decreased to be excessively smaller than atmospheric pressure, for example, there is a fear that air is sucked and mixed from the outside of the circulation route 20 to the inside of the circulation route 20 via the above seams. Here, a theoretical heat efficiency $\eta_e$ of this engine can be expressed by following equation (1), for example. In equation (1), $\epsilon$ denotes a compression ratio and $\kappa$ denotes a specific heat ratio of working gas.

$$\eta_e = 1 - \epsilon^{(1-\kappa)} \quad (1)$$

Hence, in the case of the working gas circulation engine 1 in which argon leakage from the circulation route 20 or air mixing to the circulation route 20 occurs due to excessive variation of the pressure in the circulation route 20 as described above to cause decrease of an argon ratio in the circulation gas, there is a fear that the heat efficiency of the working gas circulation engine 1 is deteriorated consequently.

Accordingly, in the working gas circulation engine 1 of the present embodiment, excessive pressure variation in the circulation route 20 is suppressed by performing pressure control as the electronic control unit 50 controls supply amount of at least one kind of reactant gas to be supplied from the supplying device 30 based on the pressure in the circulation route 20 and adjusts the pressure in the circulation route 20, as illustrated in FIG. 1.

The electronic control unit 50 adjusts engine output to be target output by controlling supply amount of one kind of reactant gas of the plural kinds of reactant gas to be supplied from the supplying device 30 and adjusts the pressure in the circulation route 20 to be target pressure by controlling supply amount of another kind of reactant gas. The electronic control unit 50 according to the present embodiment suppresses excessive pressure variation in the circulation route 20 while suppressing engine output variation by performing output control to adjust output of the engine main body 10 as controlling supply amount of hydrogen to be supplied from the hydrogen supplying device 32 and by performing pressure control to adjust the pressure in the circulation route 20 as controlling supply amount of oxygen to be supplied from the oxygen supplying device 31.

Specifically, the working gas circulation engine 1 includes a pressure sensor 62 as a pressure detecting device and a concentration sensor 63. The electronic control unit 50 performs pressure control based on the pressure in the circulation route 20 detected by the pressure sensor 62. In the working gas circulation engine 1, the electronic control unit 50 is provided with an acquisition determining unit 51, a hydrogen supply controlling unit 52 and an oxygen supply controlling unit 53 in a functionally conceptual manner.

The pressure sensor 62 is capable of detecting the pressure in the circulation route 20. Here, the pressure sensor 62 may be, for example, a differential pressure sensor capable of detecting differential pressure between the pressure in the circulation route 20 and atmospheric pressure as detecting the atmospheric pressure at the outside of the circulation route 20 in addition to the pressure of the circulation route 20. The concentration sensor 63 is capable of detecting concentration of at least one kind of reactant gas in the circulation gas circulating through the circulation route 20. Here, the concentration sensor 63 detects concentration of the reactant gas of which supply amount is controlled for the pressure control, that is, oxygen concentration in the circulation gas. The pressure sensor 62 and the concentration sensor 63 respectively detect the pressure and concentration in the circulation route 20. The electronic control unit 50 receives electric signals corresponding to the pressure in the circulation route 20, the atmospheric pressure, oxygen concentration and the like detected by the pressure sensor 62 and the concentration sensor 63.

The acquisition determining unit 51 performs acquisition of various information utilized for the pressure control and the output control and performs various determination. The acquisition determining unit 51 obtains accelerator opening, engine revolution speed, pressure in the circulation route 20, atmospheric pressure, oxygen concentration in the circulation route 20, oxygen temperature and oxygen supply pressure at the supplying pipe 31*b*, hydrogen temperature and hydrogen supply pressure at the supplying pipe 32*b*, and the like corresponding to electric signals from the above various sensors. Then, the acquisition determining unit 51 performs various determination based on the obtained information.

The hydrogen supply controlling unit 52 controls operation of the injection valve 32*e* of the hydrogen supplying device 32 based on the accelerator opening, the engine revolution speed, the hydrogen temperature and hydrogen supply pressure at the supplying pipe 32*b* and the like obtained by the acquisition determining unit 51, so that supply amount of hydrogen to be supplied from the hydrogen supplying device 32 is controlled. The hydrogen supply controlling unit 52 performs the output control to adjust the output of the engine main body 10 to be the target output by controlling the supply amount of hydrogen to be supplied from the hydrogen supplying device 32. The hydrogen supply controlling unit 52 determines the supply amount of hydrogen for enabling to obtain target engine output required by a driver at current engine revolution speed in accordance with a drive state such as accelerator opening and engine revolution speed, and controls the supply amount (i.e., injection amount) and supply timing (i.e., injection timing) of hydrogen with the hydrogen supplying device 32 corresponding thereto.

The oxygen supply controlling unit 53 controls operation of the injection valve 31*e* of the oxygen supplying device 31 based on the pressure in the circulation route 20, atmospheric pressure, the oxygen temperature and oxygen supply pressure at the supplying pipe 31*b* and the like obtained by the acquisition determining unit 51, so that supply amount of oxygen to be supplied from the oxygen supplying device 31 is controlled. The oxygen supply controlling unit 53 performs the pressure control to adjust the pressure in the circulation route 20 to be the target pressure by controlling the supply amount of oxygen to be supplied from the oxygen supplying device 31.

Here, the target pressure of the pressure in the circulation route 20 for the pressure control is set to be within a predetermined range to the extent that argon leakage from the circulation route 20 and air mixing to the circulation route 20 via various seams against the atmospheric pressure can be prevented. The target pressure of the pressure in the circulation route 20 is set to be within a range in the order of ±several kPa through ±10 kPa against the atmospheric pressure, for example. That is, the oxygen supply controlling unit 53 performs the pressure control so that an absolute value of the differential pressure between the pressure in the circulation route 20 and the atmospheric pressure detected by the pressure sensor 62 is to be equal to or smaller than a predetermined value, that is, several kPa through 10 kPa. Accordingly, in the working gas circulation engine 1, the range of the target pressure for the pressure control can be appropriately set. Here, in addition to preventing argon leakage from the circulation route 20 and air mixing to the circulation route 20 via the seams, abrupt change of operation states can be appropriately managed as suppressing control fluctuation caused by too narrow a range of the target pressure for the pressure control. For example, it is possible to suppress abrupt increase and decrease of the supply amount of oxygen against abrupt change of the pressure in the circulation route 20.

That is, in the case that the differential pressure obtained by subtracting the pressure in the circulation route 20 from the atmospheric pressure detected by the pressure sensor 62 becomes higher than the predetermined value, that is, several kPa through 10 kPa here, in other words, in the case that the pressure in the circulation route 20 detected by the pressure sensor 62 becomes lower than the pressure obtained by subtracting the predetermined value from the atmospheric pressure, the oxygen supply controlling unit 53 performs the pressure control to increase the pressure in the circulation route 20. On the other hand, in the case that the differential pressure obtained by subtracting the atmospheric pressure from the pressure in the circulation route 20 detected by the pressure sensor 62 becomes higher than the predetermined value, that is, several kPa through 10 kPa here, in other words, in the case that the pressure in the circulation route 20 detected by the pressure sensor 62 becomes higher than the pressure obtained by adding the predetermined value to the atmospheric pressure, the oxygen supply controlling unit 53 performs the pressure control to decrease the pressure in the circulation route 20.

Then, in the case of performing the pressure control to increase the pressure in the circulation route 20, the oxygen supply controlling unit 53 adjusts supply amount of oxygen supplied from the oxygen supplying device 31 (i.e., corresponding to at least one kind of reactant gas in the present invention) to be larger than the supply amount corresponding to a theoretical ratio of the reaction with hydrogen (i.e., corresponding to another reactant gas in the present invention) in the combustion chamber 11. That is, in the case that the pressure in the circulation route 20 becomes lower than the lower limit (in the above example, "atmospheric pressure"–"several kPa through 10 kPa") of the target pressure being set with the predetermined range, the oxygen supply controlling unit 53 adjusts the supply amount of oxygen supplied from the oxygen supplying device 31 to be larger than the supply amount corresponding to the above theoretical ratio. Here, the supply amount of oxygen corresponding to the theoretical ratio of the reaction with hydrogen in the combustion chamber 11 is the supply amount with which hydrogen of the amount determined by the hydrogen supply controlling unit 52 corresponding to accelerator opening, engine revolution speed and the like in order to obtain target engine output required by a driver is to be combusted in just proportion. Typically, the supply amount of oxygen corresponding to the theoretical ratio of the reaction with hydrogen in the combustion chamber 11 is a half in a molar ratio against the above-determined supply amount of hydrogen.

As a result, in the working gas circulation engine 1, since the oxygen supply controlling unit 53 adjusts the supply amount of oxygen supplied from the oxygen supplying device 31 to be larger than the supply amount corresponding to the theoretical ratio when the pressure in the circulation route 20 is decreased to be lower than the predetermined value, amount of excessive oxygen remaining after combustion of hydrogen in the combustion chamber 11 is increased and amount of excessive gas in the exhaust gas discharged from the combustion chamber 11 is increased. Accordingly, the working gas circulation engine 1 can increase the amount of gas circulating through the circulation route 20 and can increase the pressure in the circulation route 20 thereby.

On the other hand, in the case of performing the pressure control to decrease the pressure in the circulation route 20, the oxygen supply controlling unit 53 adjusts the supply amount of oxygen supplied from the oxygen supplying device 31 to be smaller than the supply amount corresponding to the theoretical ratio of the reaction with hydrogen in the combustion chamber 11. That is, in the case that the pressure in the circulation route 20 becomes higher than the higher limit (in the above example, "atmospheric pressure"+"several kPa through 10 kPa") of the target pressure being set with the predetermined range, the oxygen supply controlling unit 53 adjusts the supply amount of oxygen supplied from the oxygen supplying device 31 to be smaller than the supply amount corresponding to the above theoretical ratio.

As a result, in the working gas circulation engine 1, since the oxygen supply controlling unit 53 adjusts the supply amount of oxygen supplied from the oxygen supplying device 31 to be smaller than the supply amount corresponding to the theoretical ratio when the pressure in the circulation route 20 is increased to be higher than the predetermined value, oxygen contained as the excessive gas in the circulation gas circulating through the circulation route 20 is to be consumed as a shortfall of the supply amount of oxygen corresponding to the above theoretical ratio in addition to oxygen supplied from the oxygen supplying device 31 for the combustion of hydrogen in the combustion chamber 11. Accordingly, the working gas circulation engine 1 can decrease the excessive gas in the circulation gas and decrease the amount of gas circulating through the circulation route 20 and can decrease the pressure in the circulation route 20 thereby.

At that time, in the working gas circulation engine 1, by performing the pressure control to decrease the pressure in the circulation route 20 as described above, the excessive oxygen in the circulation gas being increased when the pressure control to increase the pressure in the circulation route 20 can be consumed for the combustion of hydrogen in the combustion chamber 11 without being discharged to the outside of the circulation route 20, for example. Accordingly, it is possible to prevent oxygen from being consumed in vain due to the pressure control.

Here, in the case of performing the pressure control to decrease the pressure in the circulation route 20 as described above, it is preferable that the oxygen supply controlling unit 53 performs the pressure control to decrease the pressure in the circulation route 20 as adjusting the supply amount of oxygen supplied from the oxygen supplying device 31 to be smaller than the supply amount corresponding to the above theoretical ratio on the condition that oxygen of predetermined amount to the extent necessary for the combustion of hydrogen in the combustion chamber 11 is contained as the excessive gas in the circulation gas circulating through the circulation route 20. In this case, for example, the acquisition determining unit 51 obtains the oxygen concentration in the circulation route 20 corresponding to the electric signal from the concentration sensor 63 and determines whether or not oxygen of the predetermined amount to the extent necessary for the combustion of hydrogen in the combustion chamber 11 for the current cycle is contained in the circulation gas based on the oxygen concentration. Then, when the acquisition determining unit 51 determines that oxygen of the above predetermined amount is contained in the circulation gas, the oxygen supply controlling unit 53 performs the pressure control to decrease the pressure in the circulation route 20.

As described above, in the working gas circulation engine 1, excessive pressure variation in the circulation route 20 can be suppressed even in the case that the circulation gas is expanded or contracted due to temperature variation of the circulation gas circulating through the circulation route 20 corresponding to variation of a warming-up condition or a driving-load condition of the engine main body 10 or variation of external environment temperature, for example, by performing the pressure control as adjusting supply amount of oxygen to be supplied from the oxygen supplying device 31 by the electronic control unit 50. Accordingly, since the pressure in the circulation route 20 can be maintained at the vicinity of the atmospheric pressure as being suppressed from being excessively higher or excessively lower than external pressure, that is, the atmospheric pressure, the working gas circulation engine 1 can suppress leakage of argon to the outside of the circulation route 20 from the inside of the circulation route 20 and sucking and mixing of air to the inside of the circulation route 20 from the outside of the circulation route 20 via various seams. As a result, the working gas circulation engine 1 can suppress decrease of the argon ratio in the circulation gas and can suppress deterioration of the heat efficiency of the working gas circulation engine 1.

Further, for example, since the pressure variation can be suppressed only by adjusting the supply amount of oxygen supplied from the oxygen supplying device 31 even without separately arranging structure (for example, a gas-vent passage, a pump as forcing press-feeding means, a reservoir tank and the like) to extract a part of the circulation gas from the circulation route 20 in order to suppress excessive pressure variation in the circulation route 20, it is possible to suppress increase of part count constituting the working gas circulation engine 1. Accordingly, since upsizing and weight increase can be suppressed, the working gas circulation engine 1 can suppress increase of manufacturing cost while suppressing decrease of mount-easiness.

Further, in the working gas circulation engine 1, since excessive pressure variation in the circulation route 20 can be suppressed, it is not necessary to ensure sealing performance with more than sufficient margin at a slide portion such as the crank shaft 16, for example. In general, in the above working gas circulation engine 1, there is a tendency that friction at the slide portion is increased as being proportional to the sealing performance at the slide portion such as the crank shaft 16. In the working gas circulation engine 1, since the sealing performance at the slide portion is not required to be ensured with sufficient margin as described above, friction increase at the slide portion can be suppressed and fuel consumption can be improved.

Further, in the working gas circulation engine 1, since excessive increase of the pressure in the circulation route 20 can be suppressed, it is not necessary to ensure further pressure-resistance performance by increasing pressure-resistance strength of various passage piping such as the circulation passage 21 and structural members such as the cylinder head 12 and the cylinder block 13 constituting the engine main body 10 against excessive increase of the pressure in the circulation route 20, for example. Accordingly, from this viewpoint as well, since upsizing and weight increase can be suppressed, the working gas circulation engine 1 can suppress increase of manufacturing cost while suppressing decrease of mount-easiness.

Further, in the working gas circulation engine 1, since excessive increase of the pressure in the circulation route 20 can be suppressed, excessive increase of the maximum in-cylinder pressure in the combustion chamber 11 can be suppressed, for example. Therefore, it is not necessary to ensure further pressure-resistance performance by increasing pressure-resistance strength of the structural members. Accordingly, from this viewpoint as well, since upsizing and weight increase can be suppressed, the working gas circulation engine 1 can suppress increase of manufacturing cost while suppressing decrease of mount-easiness.

Further, in the working gas circulation engine 1, since the pressure control to adjust the pressure in the circulation route 20 is performed by controlling the supply amount of oxygen to be supplied from the oxygen supplying device 31, oxygen is the excessive reactant gas possibly contained in the circulation gas as remaining after the combustion of hydrogen in the combustion chamber 11 as described above. In general, there is a tendency that oxygen having a relatively large molecule diameter is resistant to leakage via seams compared to hydrogen having a relatively small molecule diameter. In the working gas circulation engine 1, since the excessive reactant gas possibly contained in the circulation gas circulating through the circulation route 20 is oxygen, the sealing at the above seams and the like can be performed relatively easily. Accordingly, from this viewpoint as well, the working gas circulation engine 1 can suppress increase of manufacturing cost. In addition, in the working gas circulation engine 1, since the excessive reactant gas possibly contained in the circulation gas circulating through the circulation route 20 is oxygen, the reactant gas is not to be ignited in the circulation route 20.

Further, in the working gas circulation engine 1, the oxygen supplying device 31 constituting the supplying device 30 supplies the reactant gas (i.e., oxygen) of which supply amount is controlled to adjust the pressure in the circulation route 20 to the circulation route 20, that is, to the intake port 17 here. Accordingly, in the working gas circulation engine 1, oxygen injected from the injection valve 31*e* and the circulation gas passing through the intake port 17 can be fed into the combustion chamber 11 after being previously mixed. Therefore, for example, compared to the case of directly supplying to the combustion chamber 11, influence of the pressure control can be suppressed against the combustion of hydrogen in the combustion chamber 11, so that the combustion of hydrogen in the combustion chamber 11 can be stabilized. Further, in the working gas circulation engine 1, since oxygen of which supply amount is controlled to adjust the pressure in the circulation route 20 is supplied to the circulation route 20, oxygen can be supplied to the circulation route 20 even in the case that the pressure control is performed during operation is stopped as described later, for example.

Here, the electronic control unit 50 of the present embodiment may perform the pressure control in both operation states of an operation state with occurrence of the reaction of the plural kinds of reactant gas in the combustion chamber 11 and an operation state without occurrence of the reaction of the plural kinds of reactant gas in the combustion chamber 11. The electronic control unit 50 performs pressure control in operation in the operation state that the reaction of oxygen and hydrogen occurs in the combustion chamber 11, that is, the operation state that the working gas circulation engine 1 outputs power. Meanwhile, the electronic control unit 50 performs pressure control in non-operation in the operation state that the reaction of oxygen and hydrogen does not occur in the combustion chamber 11, that is, the operation state that operation of the working gas circulation engine 1 is stopped.

In the working gas circulation engine 1, when the operation state is varied from the operation state of outputting power to the operation state of stopped operation, temperature of gas in the circulation route 20 (in a precise sense, the gas in the circulation route 20 is not circulated in the state of stopped operation) is basically varied to a relatively decreasing side and the pressure in the circulation route 20 is varied to a decreasing side in most cases. Therefore, the pressure control in non-operation which is performed by the electronic control unit 50 is basically the pressure control to increase the pressure in the circulation route 20 by simply supplying oxygen from the oxygen supplying device 31. Consequently, in the working gas circulation engine 1, even though the gas in the circulation route 20 is contracted as the temperature thereof decreases corresponding to transition of the engine main body 10 from a warmed-up state to a cooled state after operation stopped, the pressure in the circulation route 20 can be prevented from being excessively decreased against the atmospheric pressure. Accordingly, it is possible to suppress sucking and mixing of air to the inside of the circulation route 20 from the outside of the circulation route 20 via various seams even when the operation is stopped. Hence, in the working gas circulation engine 1, it is possible to suppress deterioration of the heat efficiency of the working gas circulation type engine 1 during operation.

Next, an example of the pressure control in operation and the pressure control in non-operation of the working gas circulation engine 1 will be described with reference to flowcharts of FIGS. 2 and 3. These control routines are performed as being repeated with a cycle of several milliseconds to several tens of milliseconds. Here, the pressure control in non-operation of FIG. 3 may be performed every time after operation of the working gas circulation engine 1 is stopped or may be performed at each predetermined time corresponding to a timer and the like.

In the pressure control in operation described in FIG. 2, first, the acquisition determining unit 51 obtains accelerator opening and engine revolution speed corresponding to electric signals from the accelerator opening sensor 60 and the crank angle sensor 61 (S100).

Next, the hydrogen supply controlling unit 52 calculates supply amount A of hydrogen enabling to obtain target engine output required by a driver at current engine revolution speed from a supply amount map (not illustrated) previously stored in a memory unit, for example, based on the accelerator opening and engine revolution speed obtained by the acquisition determining unit 51 (S102).

Next, the oxygen supply controlling unit 53 calculates supply amount B of oxygen (i.e., a half supply amount in molar ratio against the supply amount A) corresponding to the theoretical ration for combusting hydrogen of the supply amount A calculated by the hydrogen supply controlling unit 52 in S102 (S104).

Next, the acquisition determining unit 51 obtains pressure in the circulation route 20 and the atmospheric pressure corresponding to electric signal from the pressure sensor 62 (S106).

Next, the acquisition determining unit 51 determines whether or not differential pressure obtained by subtracting the pressure in the circulation route 20 from the atmospheric pressure obtained in S106 is larger than the predetermined value, that is, several kPa through 10 kPa here (S108).

In the case that the differential pressure obtained by subtracting the pressure in the circulation route 20 from the atmospheric pressure is determined being larger than the predetermined value by the acquisition determining unit 51 ("Yes" in S108), the oxygen supply controlling unit 53 sets the supply amount B of oxygen calculated in S104 as being previously increased by set amount (S110). Then, the hydrogen supply controlling unit 52 and the oxygen supply controlling unit 53 perform to supply hydrogen and oxygen by controlling the hydrogen supplying device 32 and the oxygen supplying device 31 based on the supply amount A of hydrogen calculated in S102 and the supply amount B of oxygen set as being amount-increased in S110 (S112). Thus, the current control cycle is completed to proceed to the next control cycle.

In the case that the differential pressure obtained by subtracting the pressure in the circulation route 20 from the atmospheric pressure is determined being equal to or smaller than the predetermined value in S108 ("No" in S108), the acquisition determining unit 51 subsequently determines whether or not differential pressure obtained by subtracting the atmospheric pressure from the pressure in the circulation route 20 is larger than the predetermined value (S114).

In the case that the differential pressure obtained by subtracting the atmospheric pressure from the pressure in the circulation route 20 is determined being larger than the predetermined value ("Yes" in S114), the acquisition determining unit 51 subsequently obtains oxygen concentration in the circulation route 20 corresponding to the electric signal from the concentration sensor 63 and determines whether or not the oxygen amount in the circulation gas is equal to or larger than a predetermined amount to the extent necessary for the combustion of hydrogen in the combustion chamber 11 of the current cycle based on the oxygen concentration (S116).

In the case that the oxygen amount in the circulation gas is determined being equal to or larger than the predetermined amount by the acquisition determining unit 51 ("Yes" in S116), the oxygen supply controlling unit 53 sets the supply amount B of oxygen calculated in S104 as being previously decreased by set amount (S118). Then, the hydrogen supply controlling unit 52 and the oxygen supply controlling unit 53 perform to supply hydrogen and oxygen by controlling the hydrogen supplying device 32 and the oxygen supplying device 31 based on the supply amount A of hydrogen calculated in S102 and the supply amount B of oxygen set as being amount-decreased in S118 (S112). Thus, the current control cycle is completed to proceed to the next control cycle.

In the case that the differential pressure obtained by subtracting the atmospheric pressure from the pressure in the circulation route 20 ("No" in S114) and in the case that the oxygen amount in the circulation gas is determined being smaller than the predetermined amount ("No" in S116), the hydrogen supply controlling unit 52 and the oxygen supply controlling unit 53 perform to supply hydrogen and oxygen by controlling the hydrogen supplying device 32 and the oxygen supplying device 31 based on the supply amount A of hydrogen calculated in S102 and the supply amount B calculated in S104 (S112). Thus, the current control cycle is completed to proceed to the next control cycle.

In the pressure control in non-operation described in FIG. 3, first, the acquisition determining unit 51 determines whether or not the working gas circulation engine 1 is currently in a state of stopped operation, that is, in the operation state without occurrence of the reaction of oxygen and hydrogen in the combustion chamber 11 (S200).

In the case that the working gas circulation engine 1 is determined being in the state of stopped operation ("Yes" in S200), the acquisition determining unit 51 obtains the pressure in the circulation route 20 and the atmospheric pressure corresponding to the electric signal from the pressure sensor 62 (S202).

Next, the acquisition determining unit 51 determines whether or not the differential pressure obtained by subtracting the pressure in the circulation route 20 from the atmospheric pressure obtained in S202 is larger than a predetermined value, that is, several kPa through 10 kPa here (S204).

In the case that the differential pressure obtained by subtracting the pressure in the circulation route 20 from the atmospheric pressure is determined being larger than the predetermined value by the acquisition determining unit 51 ("Yes" in S204), the oxygen supply controlling unit 53 performs to supply oxygen of previously set amount by controlling the oxygen supplying device 31 (S206). Thus, the current control cycle is completed to proceed to the next control cycle.

In the case that the working gas circulation engine 1 is determined being not in the state of stopped operation ("No" in S200) and in the case that the differential pressure obtained by subtracting the pressure in the circulation route 20 from the atmospheric pressure in S204 is determined being equal to or smaller than the predetermined value ("No" in S204), the acquisition determining unit 51 completes the current control cycle to proceed to the next control cycle.

Next, an example of operation of the working gas circulation engine 1 will be described with reference to a time chart of FIG. 4. In this drawing, the horizontal axis denotes time and vertical axes denote pressure of circulation gas, oxygen amount of circulation gas and temperature of circulation gas. In the drawing, solid lines indicate a case with the pressure control and dotted lines indicate a case without the pressure control.

In the example illustrated in FIG. 4, the working gas circulation engine 1 is activated (i.e., the reaction of oxygen and hydrogen in the combustion chamber 11 is started) at time t4 and is deactivated (i.e., the reaction of oxygen and hydrogen in the combustion chamber 11 is stopped) at time t9. In the working gas circulation engine 1, the electronic control unit 50 performs the pressure control in non-operation corresponding to decrease of circulation gas temperature accompanied with variation of the external temperature in the non-operation state before time t4. Here, the electronic control unit 50 performs the pressure control to supply oxygen of previously set amount by controlling the oxygen supplying device 31 corresponding to the decrease of circulation gas temperature from time t1 through time t2. Meanwhile, the electronic control unit 50 stops oxygen supplying from time t2 through time t4.

Subsequently, in the working gas circulation engine 1, in the operation state from starting at time t4 until stopping at time t9, the electronic control unit 50 performs the pressure control in operation corresponding to variation of circulation gas temperature accompanied with variation of a warming-up condition or a driving-load condition of the engine main body 10. Here, the electronic control unit 50 performs the pressure control to decrease the supply amount of oxygen against the theoretical ratio with hydrogen by controlling the oxygen supplying device 31 corresponding to increase of the circulation gas temperature during warming-up operation from time t4 through time t5 and during acceleration operation from time t6 through time t7. Further, the electronic control unit 50 performs the pressure control to increase the supply amount of oxygen against the theoretical ratio with hydrogen by controlling the oxygen supplying device 31 corresponding to decrease of the circulation gas temperature during deceleration operation from time t7 through time t8. Further, the electronic control unit 50 performs the pressure control to equalize the supply amount of oxygen to the theoretical ratio with hydrogen by controlling the oxygen supplying device 31 during steady operation from time t5 through time t6 and during steady operation from time t8 through time t9.

Then, in the working gas circulation engine 1, the electronic control unit 50 performs the pressure control in non-operation corresponding to decrease of the circulation gas temperature accompanied with natural cooling of the engine main body 10 in the non-operation state after time t9. Here, the electronic control unit 50 performs the pressure control to supply oxygen of previously set amount by controlling the oxygen supplying device 31 corresponding to the decrease of circulation gas temperature from time t9 through time t10.

Consequently, in the working gas circulation engine 1, excessive pressure variation in the circulation route 20 can be suppressed in both operation states of the operation state with occurrence of the reaction of oxygen and hydrogen in the combustion chamber 11 and the operation state without occurrence of the reaction of oxygen and hydrogen in the combustion chamber 11.

The abovementioned working gas circulation engine 1 according to the embodiment of the present invention includes the combustion chamber 11 to which the plural kinds of reactant gas and the working gas having a higher specific heat ratio than air are supplied as the working gas being expandable corresponding to reaction of the plural kinds of reactant gas, the circulation route 20 capable of circulating gas containing the working gas from the exhaust side to the intake side of the combustion chamber 11 and resupplying to the combustion chamber 11 while being provided with the condenser 40 to remove a product generated from the circulating gas with the reaction, the supplying device 30 capable of supplying the plural kinds of reactant gas to the combustion chamber 11 or the circulation route 20, the pressure sensor 62 capable of detecting pressure in the circulation route 20, and the electronic control unit 50 which controls supply amount of at least one kind of the reactant gas to be supplied from the supplying device 30 based on the pressure in the circulation route 20 detected by the pressure sensor 62 and which performs pressure control to adjust the pressure in the circulation route 20. Accordingly, in the above working gas circulation engine 1, since amount of gas circulating through the circulation route 20 can be adjusted and the pressure in the circulation route 20 can be adjusted as the electronic control unit 50 performs the pressure control as controlling supply amount of oxygen based on the pressure in the circulation route 20, excessive pressure variation in the circulation route can be suppressed.

Here, not limited to the abovementioned embodiment, the abovementioned working gas circulation engine according to the embodiment of the present invention can be variously modified within the scope of the claims.

Figure 5:
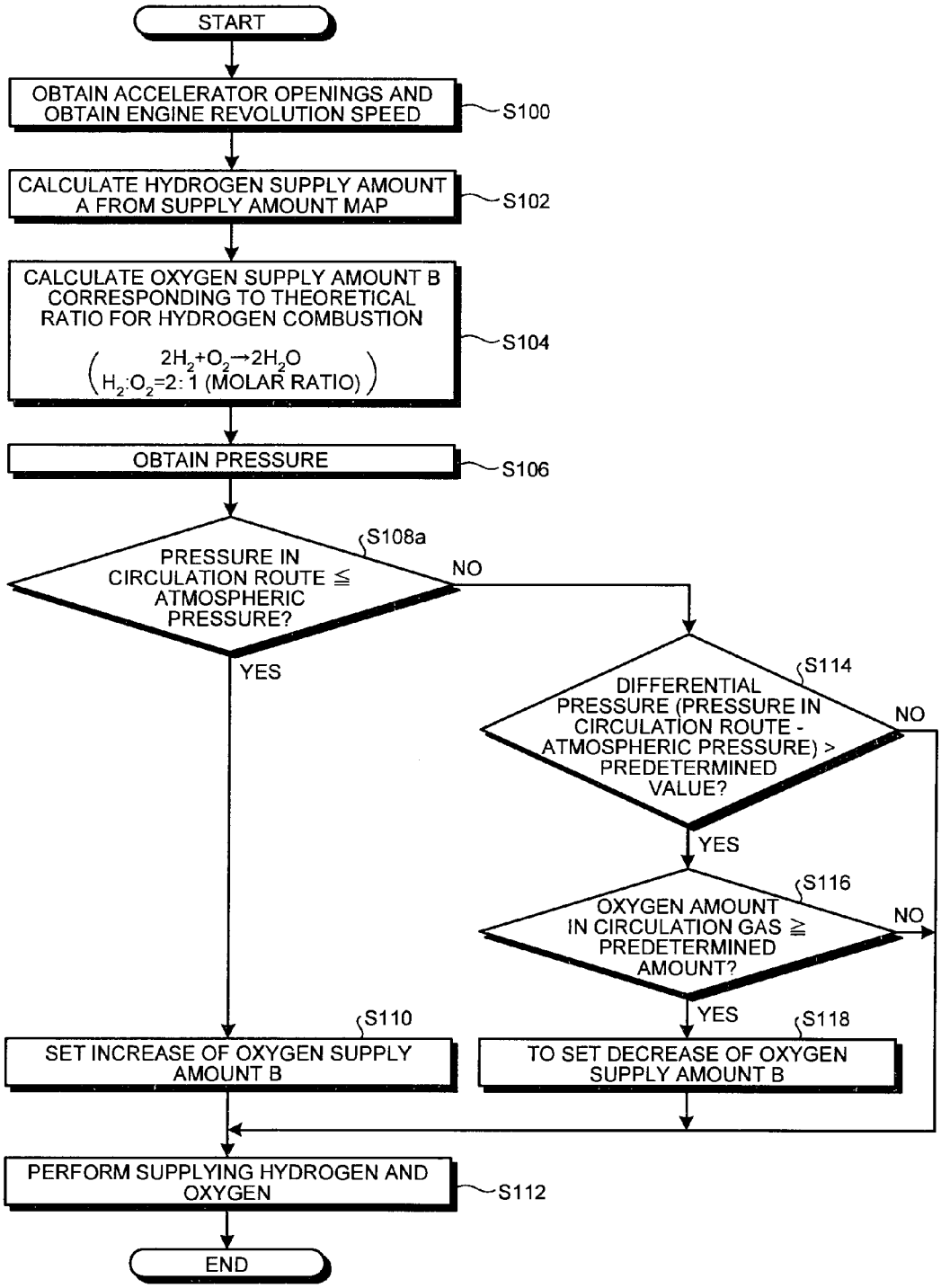
FIG. 5 is a flowchart explaining an example of pressure control in operation of the working gas circulation engine according to a modified example.

For example, the abovementioned electronic control unit 50 may be configured to perform the pressure control so that the pressure in the circulation route 20 detected by the pressure sensor 62 is to be larger than the atmospheric pressure within a range of a predetermined value which is previously set. FIG. 5 is a flowchart explaining an example of the pressure control in operation of a working gas circulation engine according to a modified example. Here, description of similar steps to the pressure control in operation described with FIG. 2 will not be repeated for minimizing description. In this case, after obtaining the pressure in the circulation route 20 and the atmospheric pressure corresponding to the electric signal from the pressure sensor 62 (S106), the acquisition determining unit 51 of the electronic control unit 50 determines whether or not the pressure in the circulation route 20 is equal to or lower than the atmospheric pressure as comparing the pressure in the circulation route 20 and the atmospheric pressure obtained in S106 (S108*a*). In the case that the pressure in the circulation route 20 is determined being equal to or lower than the atmospheric pressure by the acquisition determining unit 51 ("Yes" in S108*a*), the oxygen supply controlling unit 53 sets the supply amount B of oxygen calculated in S104 as being increased (S110). On the contrary, in the case that the pressure in the circulation route 20 is determined being higher than the atmospheric pressure ("No" in S108*a*), the acquisition determining unit 51 subsequently determines whether or not the differential pressure obtained by subtracting the atmospheric pressure from the pressure in the circulation route 20 is larger than the predetermined value (S114).

In this case, in the working gas circulation engine 1, since the pressure control is performed by the electronic control unit 50 so that the pressure in the circulation route 20 is to be larger than the atmospheric pressure within the range of the predetermined value which is previously set, it is possible to reliably prevent air mixing to the circulation route 20 via seams. In the working gas circulation engine 1, assuming that argon is leaked from the circulation route 20, for example, the heat efficiency of the working gas circulation engine 1 can be recovered by supplementing a relatively small amount of argon (that is, argon by the leaked amount) into the circulation route 20. However, assuming that air is mixed into the circulation route 20, it is necessary to supplement a relatively large amount of argon into the circulation route 20 for replacement in order to recover the heat efficiency. From this viewpoint, in the working gas circulation engine 1, in the case that the pressure control is performed by the electronic control unit 50 so that the pressure in the circulation route 20 is to be larger than the atmospheric pressure within the range of the predetermined value which is previously set, air mixing to the circulation route 20 via seams can be reliably prevented. Accordingly, even assuming that supplementing of argon into the circulation route 20 is required to recover the heat efficiency, the supplement amount thereof can be relatively small.

In the above description, the control unit performs the pressure control based on the differential pressure of the pressure in the circulation route and the atmospheric pressure. However, it is also possible to perform the pressure control simply based on the pressure in the circulation route detected by the pressure detecting device. Further, it is also possible that the abovementioned control unit performs the output control to adjust engine output by controlling supply amount of oxygen supplied from the oxygen supplying device and performs the pressure control to adjust the pressure in the circulation route by controlling supply amount of hydrogen supplied from the hydrogen supplying device. In the above case, it is also possible to suppress excessive pressure variation in the circulation route 20 appropriately as being similar to the above.

The abovementioned working gas circulation engine may be configured to inject hydrogen as fuel to the intake port 17 of the circulation route 20 and may be configured to inject oxygen as oxidizer directly into the combustion chamber 11. In the above description, the working gas circulation engine is exemplified to diffuse and combust hydrogen as fuel. However, it is also possible to have a configuration of spark ignition combustion as igniting fuel with an ignition plug (not illustrated) or a configuration of diffusing and combusting to perform ignition support by igniting the fuel with an ignition plug.

Not limited to oxygen as oxidizer and hydrogen as fuel, the plural kinds of reactant gas in the above description may be plural kinds of gas (i.e., vapor) as long as being capable of generating a product corresponding to reaction while being capable of expanding working gas corresponding to the reaction in the combustion chamber. Further, not limited to argon, the working gas in the above description may be inert gas such as helium (He) being monatomic gas, for example.

INDUSTRIAL APPLICABILITY

As described above, the working gas circulation engine according to the present invention is preferably adopted as a variety of working gas circulation engines capable of circulating working gas from an exhaust side to an intake side of a combustion chamber and resupplying to the combustion chamber.

REFERENCE SIGNS LIST

1 Working Gas Circulation Engine
10 Engine Main Body
11 Combustion Chamber
17 Intake Port
18 Exhaust Port
20 Circulation Route
21 Circulation Passage
30 Supplying Device
31 Oxygen Supplying Device
32 Hydrogen Supplying Device

40 Condenser (Removing Device)
50 Electronic Control Unit (Control Unit)
60 Accelerator Opening Sensor
61 Crank Angle Sensor
62 Pressure Sensor (Pressure Detecting Device)
63 Concentration Sensor

The invention claimed is:

1. A working gas circulation engine comprising:

a combustion chamber to which plural kinds of reactant gas and working gas having a higher specific heat ratio than air are supplied and in which the working gas is expandable corresponding to reaction of the plural kinds of reactant gas;

a circulation route configured to circulate gas containing the working gas from an exhaust side to an intake side of the combustion chamber and resupplying to the combustion chamber and provided with a removing device to remove a product generated with the reaction from the circulating gas;

a supplying device configured to supply the plural kinds of reactant gas to the combustion chamber or the circulation route;

a pressure detecting device configured to detect pressure in the circulation route; and a control unit configured to perform pressure control to adjust the pressure in the circulation route by controlling a supply amount of at least one kind of the reactant gas to be supplied from the supplying device based on the pressure in the circulation route detected by the pressure detecting device.

2. The working gas circulation engine according to claim 1, wherein the control unit performs the pressure control to adjust an absolute value of differential pressure between the pressure in the circulation route detected by the pressure detecting device and atmospheric pressure to be equal to or smaller than a previously set predetermined value.

3. The working gas circulation engine according to claim 1, wherein the control unit adjusts supply amount of at least one kind of the reactant gas supplied from the supplying device to be larger than supply amount corresponding to a theoretical ratio of the reaction with another of the reactant gas when performing the pressure control to increase the pressure in the circulation route, and adjusts supply amount of at least one kind of the reactant gas supplied from the supplying device to be smaller than the theoretical ratio of the reaction with the other of the reactant gas when performing the pressure control to decrease the pressure in the circulation route.

4. The working gas circulation engine according to claim 1, wherein the supplying device is configured to include an oxygen supplying device to supply oxygen as one of the plural kinds of reactant gas and a hydrogen supplying device to supply hydrogen to be combusted with the oxygen as one of the plural kinds of reactant gas, and the control unit performs the pressure control by controlling supply amount of the oxygen to be supplied from the oxygen supplying device.

5. The working gas circulation engine according to claim 1, wherein the supplying device supplies the reactant gas of which supply amount to the circulation route is controlled to adjust the pressure in the circulation route.

6. The working gas circulation engine according to claim 1, wherein the control unit performs the pressure control in both operation states of an operation state with occurrence of the reaction of the plural kinds of reactant gas in the combustion chamber and an operation state without occurrence of the reaction of the plural kinds of reactant gas in the combustion chamber.

7. The working gas circulation engine according to claim 1, wherein the control unit performs the pressure control to adjust the pressure in the circulation route detected by the pressure detecting device is to be larger than atmospheric pressure within a range of a previously set predetermined value.

* * * * *